US006485366B1

(12) United States Patent
Rowe

(10) Patent No.: US 6,485,366 B1
(45) Date of Patent: Nov. 26, 2002

(54) ELECTRONIC GAMING METHOD AND APPARATUS USING SIMULATED NUMBER CARD DECK

(75) Inventor: Rick Rowe, Reno, NV (US)

(73) Assignee: International Game Technology, Reno, NV (US)

( * ) Notice: Subject to any disclaimer, the term of this patent is extended or adjusted under 35 U.S.C. 154(b) by 0 days.

(21) Appl. No.: 09/539,277

(22) Filed: Mar. 30, 2000

(51) Int. Cl.[7] ..... A63F 13/00

(52) U.S. Cl. ..... 463/13; 273/292; 273/303; 273/306

(58) Field of Search ..... 273/292, 274, 273/303–306; 463/13, 12

(56) References Cited

U.S. PATENT DOCUMENTS 4,926,327 A * 5/1990 Sidley ..... 463/13
5,106,100 A 4/1992 Yih ..... 273/306
5,213,334 A 5/1993 Yih ..... 273/292
5,853,325 A * 12/1998 Kadlic ..... 463/13
5,863,043 A 1/1999 Bitner ..... 273/299

OTHER PUBLICATIONS

How to Play Uno, http://www.iserv.net/~central/GAMES/uno/unorules.html.
Uno Variations, http://www.iserv.nte/~central/GAMES/uno/unorules.html.

* cited by examiner

*Primary Examiner*—Benjamin H. Layno
(74) *Attorney, Agent, or Firm*—George H. Gerstman; Seyfarth Shaw

(57) ABSTRACT

A single-player casino-style electronic gaming method and apparatus uses a deck of (simulated) number of cards and wild cards. The number cards each have a number and a color. In response to a wager, a number of, such as seven, cards are displayed to the player. The player may choose to discard any, all or none of the initially-dealt cards. Any discarded cards are replaced, to form a final hand. Prizes are awarded including based on how many cards of the same number and/or how many cards of the same color are in the final hand.

21 Claims, 3 Drawing Sheets

FIG. 4A 412 418 420 422 414 416

| INITIAL DEAL | YELLOW 7 | BLUE 6 | YELLOW 2 | RED 4 | GREEN 8 | RED 7 | WILD |
|---|---|---|---|---|---|---|---|
| DECISION | KEEP | DISCARD | DISCARD | DISCARD | DISCARD | KEEP | KEEP |
| FINAL HAND | YELLOW 7 | GREEN 7 | WILD | BLUE 7 | WILD | RED 7 | WILD |

FIG. 4B 422 424 426

| INITIAL DEAL | BLUE 3 | GREEN 8 | GREEN 4 | YELLOW 2 | RED 0 | GREEN 5 | WILD |
|---|---|---|---|---|---|---|---|
| DECISION | DISCARD | KEEP | KEEP | DISCARD | DISCARD | KEEP | KEEP |
| FINAL HAND | GREEN 1 | GREEN 8 | GREEN 4 | GREEN 2 | GREEN 3 | GREEN 5 | WILD |

ELECTRONIC GAMING METHOD AND APPARATUS USING SIMULATED NUMBER CARD DECK

The present invention is directed to a wager-accepting and prize-awarding gaming apparatus and method using a simulated card deck and in particular to a gaming method and apparatus using a deck of number cards.

BACKGROUND INFORMATION

Casino style gaming terminals (i.e., gaming terminals which are configured to accept coin, token or other monetary wagers and to payout prizes for winning outcomes) have been used to implement numerous types of games including, slot machine games and numerous types of simulated card games (i.e., games in which images of various playing cards are displayed, typically on an LCD or other display device). One of the more popular such gaming terminals is configured for playing any of a variety of (simulated) poker-style games including, commonly, five card draw poker. In general, the nature of poker games has made it somewhat straightforward to implement most features of a card-based poker game in an electronic form, with relatively few modifications of the poker game. For example, although there are many variations of poker in both card versions and electronic versions, it is relatively straightforward (and has proved relatively popular) to provide an electronic version which, compared to a card version of five card draw poker, uses the same number of cards (52) the same type of play (drawing to improve a dealt hand), with the same cards in the deck, and the same types of items constituting relatively higher or desirable hands, including pairs, three of a kind, full house, straights and flushes. The major difference has been providing for single-player gaming, with prizes based on a paytable in the electronic version, but with most of the other features of the card version remaining intact.

From the point of view of a casino or other game operator, the success or usefulness of a particular electronic gaming method and apparatus can be measured in terms of a rate of wagering, i.e., how many wagers are placed, on average, on a given gaming terminal, per day (or other time period). In general, success, in these terms, is affected by a factor such as the attractiveness or popularity of the game with the gaming public (affecting, e.g., how long a gaming terminal remains idle) and the rapidity of game play, i.e., how frequently new wagers are placed. Without wishing to be bound by any theory, it is believed that rapidity of wagering can be affected by the gaming public's perception of the difficulty or simplicity of playing the game and/or how strongly a player's choices (or apparent choices) affect the game outcome. It is believed that at least some members of the public may perceive poker, including electronic poker, as a game involving substantial strategic or other complexity.

Although electronic poker gaming terminals have proved to be relatively successful, it is believed there is a potential for achieving additional success with electronic gaming terminals which implement gaming methods that are perceived by the public as being relatively simpler games, compared with electronic poker games. Accordingly, it is believed that some members of the potential gaming public will avoid (or limit playing time at) poker terminals and/or will spend substantial time considering strategy (e.g., in making draw choices). Thus, regardless of whether these public perceptions are accurate, it is believed there is at least a segment of the potential gaming public who will tend to lower the average wagering rate on electronic poker machines. Accordingly, it would be useful to provide an electronic casino style simulated card game which provides at least the perception of somewhat simplified gaming play or strategy, compared to the perception often attached to poker gaming devices.

Additionally, it is believed there are segments of the potential gaming public who have had positive experiences with non-poker deck card games and who would be attracted to the electronic games which are reminiscent of such non-poker games. For example, many members of the potential gaming population have had positive gaming experience with games involving number card decks (i.e., decks without face cards). One example of a game played with a number card deck is that available from Mattel Company and sold under the trade name Uno®.

Unfortunately, there does not appear to be a straightforward way of implementing Uno® as a single player game on a casino style gaming terminal. Many features of the Uno® game and of the Uno® card deck itself are related to the interactive, multiple-player nature of Uno®. Indeed, the Uno® instructions (available, e.g., at http://www.iserb.net/~/central/games/uno/unorules.html) specify "two to ten players". For example, the Uno® deck includes a "draw two" card which requires the next player to draw two cards. The Uno® deck includes a reverse card which reverses the direction of play among the various players (e.g., clockwise to counterclockwise). The standard Uno® deck includes a skip card causing the next player to lose a turn. The standard Uno® deck includes a wild draw-four card which, when played, causes the next player to draw four cards. Another interactive feature of Uno® relates to the object of the game, which is to be the first, among a plurality of players, to deplete one's hand.

In addition to the inherently interactive (non-single player) nature of standard Uno® and of the standard Uno® deck, the relative length of play, before a win event, is typically relatively long since it requires repeated play, among the players, until one player's hand is depleted. In at least one version of Uno®, the winner receives points based on the number and type of cards remaining in opponent's hands and play continues until a player reaches or exceeds 500 points. The relatively slower pace of a standard Uno® game (compared to, e.g., standard poker play) is thus substantially inconsistent with a desire to provide rapid turnover (and high wagering rates). Further, whereas traditional card-based poker is commonly played in a manner involving wagering and winnings, standard Uno® rules have no implementation of a wagering or winning system. Accordingly, it would be useful to provide a casino style electronic gaming terminal implementing a game based on a (simulated) number card deck which could be provided as a single-player game, preferably with a relatively high wagering rate.

SUMMARY OF THE INVENTION

The present invention includes a recognition of the existence, nature and/or source of problems in previous gaming methods or apparatuses, including as described herein. In one aspect, the present invention adapts a number card deck and/or gaming method, changing it to make it more suitable for single-player electronic gaming. In one embodiment, changes include some or all of reducing the number of cards in a deck, e.g., by eliminating skip, reverse or other cards more directed to multiple-player games, changing the object of the game, e.g., from a hand-depletion object to a high-score hand object, changing game play, e.g., from play involving matching a number or card from a previous discard, to a play involving drawing for the purpose of providing desirable or winning combinations, compatible with a relatively larger hand of the type associated with certain previous number card games; providing for receiving wagers and awarding pay-outs, e.g., based on a paytable which accommodates a relatively larger number of cards in a hand and the like.

Preferably, game play according to the present invention uses a (simulated) card deck of a type similar to card decks which, it is believed, potential players consider less complicated or strategic than, e.g., what may be commonly associated with poker games, such as providing cards which have numbers and colors, or which include wild cards, (but without face cards), but which nevertheless provides a relatively fast-paced game (e.g., compared to a standard Uno® game), thus creating an environment in which relatively high wager rates are more likely.

BRIEF DESCRIPTION OF THE DRAWINGS

FIGS. 4A and 4B depict initial and final hands as two examples of game play according to embodiments of the present invention.

DETAILED DESCRIPTION OF THE PREFERRED EMBODIMENT

Figure 1:
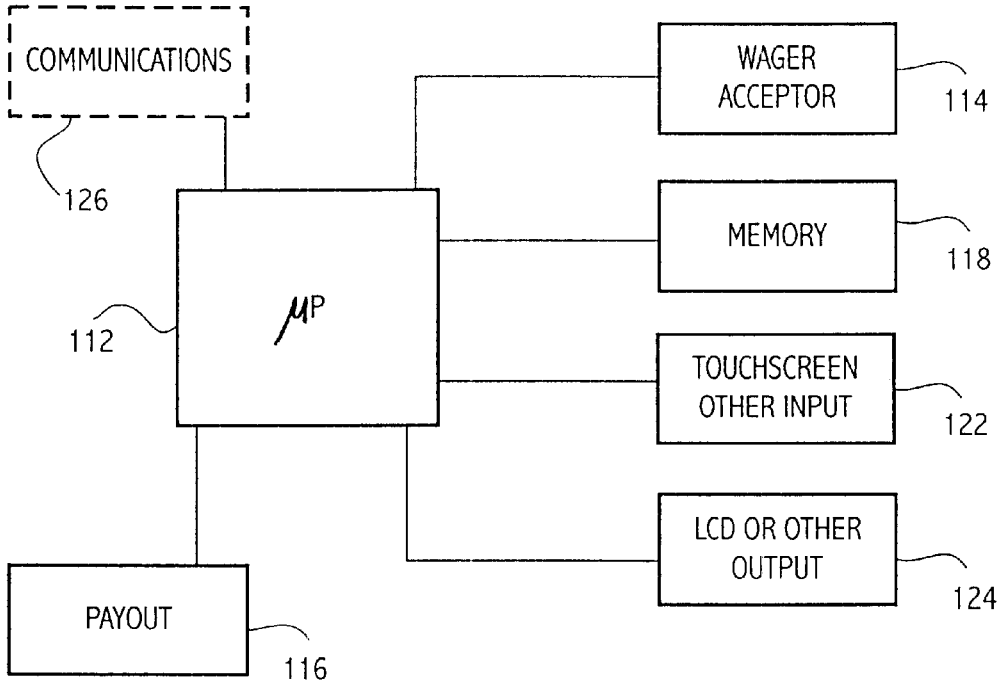
FIG. 1 is a block diagram of components of a gaming terminal according to an embodiment of the present invention.

The present invention can be implemented in any of a number of types of gaming terminals or other electronic devices. In the embodiment of FIG. 1, a gaming terminal is controlled by a microprocessor 112 which is coupled to a wager acceptor 114 (such as a coin acceptor, bill validator, credit card reader or the like) and to a payout unit 116 (such as a coin output unit, and the like). The microprocessor 112 is coupled to one or more memory units 118 which can hold, among other things, programming and/or data for defining and controlling the game, including game operation programming, tables defining the simulated cards, the hierarchy of hand types or values, the paytable defining payouts for various game outcomes and the like.

Commonly, a touch screen 122 can be provided for receiving user input (such as requesting a deal, requesting or indicating discard selections and the like), although other input devices can be used such as buttons, keys or keyboards, pointing devices such as a mouse, trackball, voice recognition input and the like. A display such as an LCD display 124 can be used for displaying the (simulated) dealt and/or replacement cards, as well as displaying items such as attract displays, winnings and/or wagers, bonus displays or games and the like. Those of skill in the art will understand how to store programming data, tables and the like in memory and will understand how to create programming for performing various gaming steps, after understanding the present disclosure.

Although it is possible to implement the present invention using a standalone gaming terminal, the gaming terminal can, if desired, be provided with a modem or other communications module 126, e.g., for communicating with a casino computer or remote "central" computer, for purposes such as accounting and bookkeeping, security, maintenance, downloading of new programming, such as providing for new game features, displays and the like.

According to one embodiment of the invention, the game is configured on the basis of a deck of 80 (simulated) cards. The deck preferably includes a number of wild cards (which can be used in place of any desired number or color) and preferably, all remaining cards are associated with one of a plurality of numbers (such as numbers 0–9) and one of a plurality of (e.g., four) colors. Table I shows the configuration, in general, of a deck of (simulated) cards which can be used in accordance with one embodiment of the present invention.

TABLE I

| TYPE OF CARD | NO. IN DECK |
|---|---|
| blue - 0–9 | 19 |
| green - 0–9 | 19 |
| red - 0–9 | 19 |
| yellow - 0–9 | 19 |
| wild cards | 4 |

The manner in which the cards will be distributed among the various groups (e.g., whether the 19 red cards include a single zero card and two each of 1–9 cards or a single 9 card and two each of 0–8 cards, or a single zero card a single 1 card, three 2 cards and 2 each of 3–9, or other combinations) will have some effect on the probability of various types of winning hands occurring, but can otherwise be selected as desired. Although the deck configuration of Table I can be used in at least one embodiment of the present invention, those of skill in the art will understand how to select other potential deck configurations useable with other embodiments of the present invention (including decks having more or fewer cards, having more or fewer numbers, having more or fewer or different colors and the like) after understanding the present disclosure. Nevertheless, the deck configuration of Table I is believed to be particularly useful and generally preferable because it is believed to be a configuration more attractive to potential players than many other alternatives.

During play of the game (e.g., as described more thoroughly below), the microprocessor is programmed to randomize, select and/or display (simulated) cards. If desired, this can be accomplished by associating each card with a card identifier and storing sets or subsets of all of the card identifiers in a list or table. The table can then be operated on by the microprocessor to perform randomization (and/or random selection processes), or to control the display, as will be understood by those of skill in the art after understanding the present disclosure.

Figure 2:
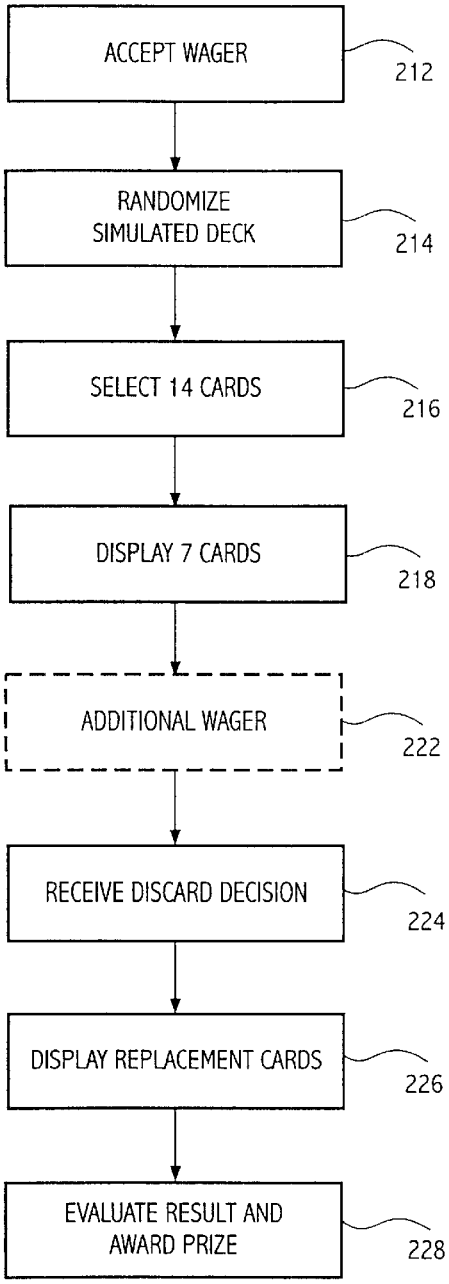
FIG. 2 is a flow chart depicting steps in a gaming process according to an embodiment of the present invention.

As depicted in FIG. 2, according to the depicted embodiment, play begins with accepting a wager 212, e.g., by one wager acceptor 114. The microprocessor 112 then randomizes the simulated card deck 214. It is also possible to perform game play without randomizing the deck, if card selection is performed using a random selection procedure. In the depicted embodiment, fourteen of the cards, out of the deck of eighty cards, are selected 216 (e.g., either randomly selected or selected from a randomized deck). Images of seven of these fourteen cards (e.g., the first seven selected cards) are displayed 218, such as on a display device 124. This set of seven displayed cards constitutes the initial deal 412 (FIG. 4A). Each of the displayed cards in the initial hand or deal is either a wild card 422 or has both a number 420 and a color 418 associated with it. The display presented to the user shows the number and color (or "wild" card) for each card in the initial deal 412. If desired, the present invention can be configured to provide for more than one opportunity to place a wager and, in the embodiment of FIG. 2, an additional wager may be provided 222 after the display of the initial card and before receiving replacement cards.

After the initial deal 412, the player is permitted to select between zero and seven cards as cards which the player wishes to discard 414. In one embodiment, the LCD presents the player with a prompt to select any cards desired for discard (or to indicate a desire to not discard any cards). In a touchscreen implementation, the system can be configured to allow a user to select a card for discard by touching the image of the card. It is also possible to provide buttons or keys, e.g., aligned with, or labeled with, the various card positions and permit the player to discard a card by pressing a corresponding button.

After the microprocessor has received the discard decisions 224, the microprocessor will then choose between zero and seven replacement cards (one replacement card for replacing each discarded card). For example, the computer may select as replacement cards, between zero and seven of the initially-selected cards 216 remaining after the initial seven cards were dealt.

Images of the replacement cards (along with any kept original cards) are then displayed 226 to provide a display of a final hand 416. Each card in the final hand will be displayed, to the user, as either a wild card or showing both the number and color of the card.

Figure 3:
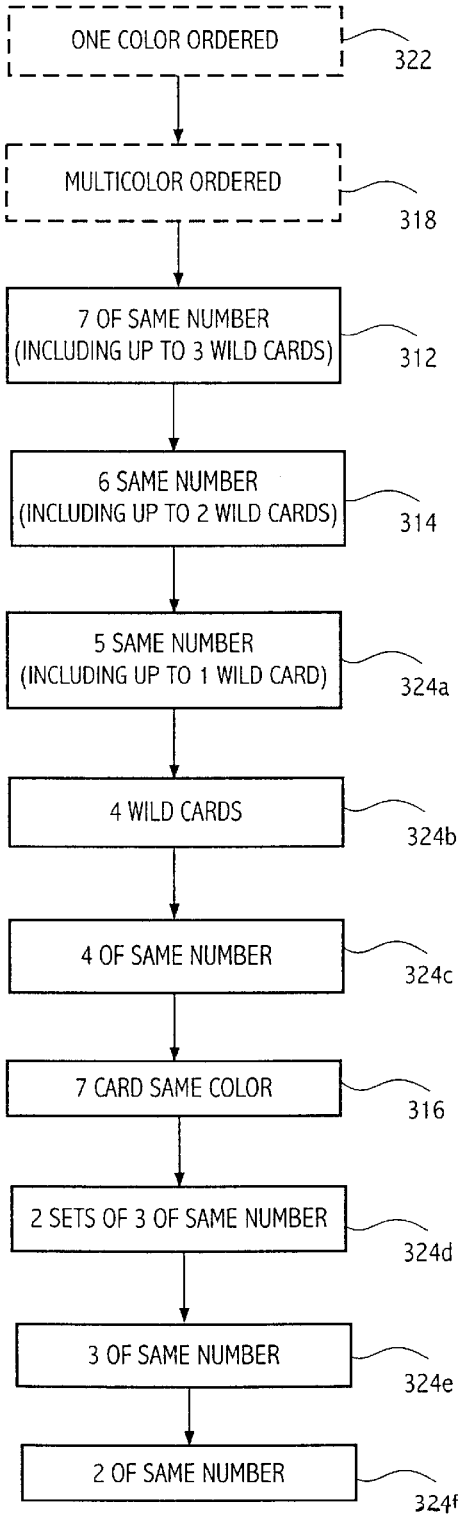
FIG. 3 is a block diagram depicting a hierarchy of game outcomes or hand values according to an embodiment of the present invention.

The microprocessor then evaluates the final hand to determine whether the final hand should result in the award or payout of a prize and, if so, initiates the payout 228. Preferably the computer will ascribe to any wild cards whichever numbers and colors result in the largest prize (if any) to a player. It is also possible to provide games in which players must choose the color and number to be ascribed to wild cards, in one embodiment for any wild cards in the initial hand preferably before replacement cards are dealt. The payouts are related to the type of final hand, with payouts being provided based on the number of cards in the hand having the same number and/or having the same color. Although many types of payout schedules can be used, it is preferred to provide a number of different levels of payout or prize with the highest or most valuable prizes being awarded when the final hand is of a type which is relatively more rare (i.e. has the lowest odds of occurring). For example, the payout could provide one prize if the final hand (considering wild cards as having the "most favorable" number) had seven cards with the same number (e.g., including up to three wild cards 312, whereas a second, somewhat smaller prize would be associated if the final hand had six cards with the same number with up to two wild cards 314). FIG. 4A depicts one example of an initial deal 412, discard decision 414, and final hand 416 having all the same number (including two wild cards). In the depicted embodiment, a prize is also associated with a final hand which has all cards of the same color. FIG. 4B depicts an example of an initial deal 422, discard decision 424 and final hand 426 resulting in an all-green final hand (including one wild card). In some embodiments, prizes may be associated with hands which have seven (or some other number) of the cards in the final hand representing a sequence (not necessarily displayed in order) such as a hand containing 3, 4, 5, 6, 7, 8 and 9, either with multiple colors 318 or of a single color 322. Other types of winning hands that can be associated with prizes 324*a–e* that are depicted in FIG. 3. It is also possible to implement embodiments of the present invention having more, fewer and/or different prize-associated final hands, as will be understood by those of skill in the art after understanding the present disclosure.

In light of the above description, a number of advantages of the present invention can be seen. The present invention provides a manner making it feasible to provide a game using a number deck, in an electronic terminal which provides a casino-style game for a single player. The present invention provides a game which is believed to be at least perceived as relatively less complicated or involving less strategy than, e.g., electronic poker, thus potentially attracting a different, additional and/or wider potential playing public. The present invention provides a game using a number deck which is nevertheless relatively fast-paced and is believed to provide the potential for relatively high average wagering rates.

A number of variations and modifications of the invention can be used. It is possible to use some features of the invention without using others. For example, it is possible to provide a single player casino-style electronic gaming method and apparatus based on a (simulated) number card deck, without being restricted to only an eighty card deck.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g. for improving performance, achieving ease and/or reducing cost of implementation. The present invention includes items which are novel, and terminology adapted from previous and/or analogous technologies, for convenience in describing novel items or processes, do not necessarily retain all aspects of conventional usage of such terminology.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A computer-implemented gaming method for casino gaming involving a single player, comprising:

providing a deck of displayable simulated card indicia having more than fifty-two of said card indicia and including a first plurality of said card indicia each having an associated color and an associated number said first plurality of said card indicia having no joker or wild card indicia, and a second plurality of wild card indicia;

receiving a wager from a player;

displaying to said player a first predetermined number of randomly-selected ones of said first and second pluralities of card indicia;

receiving from said player indications of which, if any, of said displayed card indicia said player wishes to discard;

replacing any discarded card indicia with randomly-selected replacement card indicia to form a final hand; and evaluating said final hand and awarding a prize at least if said final hand includes at least a second predetermined number of card indicia having identical associated numbers or includes at least a third predetermined number of card indicia having identical associated colors.

2. A method, as claimed in claim 1, wherein said first predetermined number is seven.

3. A method, as claimed in claim 1, wherein said second predetermined number is at least three.

4. A method, as claimed in claim 1, wherein said third predetermined number is seven.

5. A method, as claimed in claim 1, wherein said associated color is selected from among four colors.

6. A method, as claimed in claim 1, wherein said deck of simulated card indicia includes exactly eighty card indicia.

7. Apparatus as claimed in claim 1 wherein said first predetermined number is seven.

8. Apparatus as claimed in claim 1 wherein said group of simulated card indicia includes exactly eighty card indicia.

9. Apparatus as claimed in claim 1 wherein the card indicia have no face cards.

10. A gaming apparatus for casino gaming involving a single player comprising:

a gaming terminal including an electronic data processor coupled to a display device, an input device and a wager acceptor;

said electronic data processor being programmed to:

display, in response to receiving a wager from a player, a first predetermined number of card indicia selected from a deck of displayable simulated card indicia having more than fifty-two of said card indicia and including a first plurality of card indicia each having an associated color and an associated number said first plurality of said card indicia having no joker or wild card indicia, and a second plurality of wild card indicia;

receive from said player, using said input device, indications of which, if any, of any said displayable simulated card indicia said player wishes to discard;

replace discard card indicia with a randomly-selected replacement selected from said displayable simulated card indicia to form a final hand;

evaluate said final hand;

award a prize if said final hand includes at least a second predetermined number of card indicia having the same associated number or including at least a third predetermined number of card indicia having the same associated color.

11. Apparatus as claimed in claim 7 wherein said second predetermined number is at least three.

12. Apparatus as claimed in claim 7 wherein said third predetermined number is seven.

13. Apparatus as claimed in claim 7 wherein said associated color is selected from among four colors.

14. Apparatus as claimed in claim 7 wherein said debt of simulated card indicia includes exactly eighty card indicia.

15. A computer implemented gaming apparatus for casino gaming involving a single player comprising:

means for storing a group of displayable simulated card indicia having more than fifty-two of said card indicia and including a first plurality of card indicia each having an associated color and an associated number said first plurality of said card indicia having no joker or wild card indicia, and a second plurality of wild card indicia;

means for receiving a wager from a player;

means for displaying, in response to receiving a wager, a first predetermined number of randomly-selected ones of said first and second pluralities of card indicia;

means for receiving, from said player, indications of which, if any, of said display card indicia said player wishes to discard;

means for replacing any discarded card indicia with randomly-selected replacement card indicia to form a final hand; and means for evaluating said final hand and awarding a prize if said final hand includes at least a second predetermined number of card indicia having the same associated number or includes at least a third predetermined number of card indicia having the same associated color.

16. Apparatus as claimed in claim 13 wherein said first predetermined number is seven.

17. Apparatus as claimed in claim 13 wherein said second predetermined number is at least three.

18. Apparatus as claimed in claim 13 wherein said third predetermined number is seven.

19. Apparatus as claimed in claim 13 wherein said associated color is selected from among four colors.

20. Apparatus as claimed in claim 15 wherein said means for evaluating and awarding comprises a programmed computer.

21. A computer-implemented gaming method for casino gaming involving a single player, comprising:

providing a deck of displayable simulated card indicia and including a first plurality of said card indicia each having an associated color and an associated number and a second plurality of wild card indicia;

receiving a wager from a player;

displaying to said player a first predetermined number of randomly-selected ones of said first and second pluralities of card indicia;

receiving from said player indications of which, if any, of said displayed card indicia said player wishes to discard;

replacing any discarded card indicia with randomly-selected replacement card indicia to form a final hand; and evaluating said final hand and awarding a prize at least if said final hand includes at least a second predetermined number of card indicia having identical associated numbers or includes at least a third predetermined number of card indicia having identical associated colors wherein said associated number is selected from among digits 0 through 9.

* * * * *